US006157303A

United States Patent [19]

Bodie et al.

[11] Patent Number: 6,157,303

[45] Date of Patent: Dec. 5, 2000

[54] WATER SAFETY PORTABLE TRANSMITTER AND RECEIVER

[75] Inventors: John Bodie, Kanata; Douglas George, Nepean; Scott Gibson, Glen Eagle, all of Canada

[73] Assignee: Terrapin Communications Inc., Ottawa, Canada

[21] Appl. No.: 09/358,443

[22] Filed: Jul. 22, 1999

Related U.S. Application Data

[60] Provisional application No. 60/094,144, Jul. 24, 1998.

[51] Int. Cl.[7] ..... G08B 23/00

[52] U.S. Cl. ..... 340/573.6; 340/539; 340/604

[58] Field of Search ..... 340/573.6, 539, 340/604; 200/61.05; 73/170.26; 137/78.3

[56] References Cited

U.S. PATENT DOCUMENTS

| | | | |
|---|---|---|---|
| 4,305,143 | 12/1981 | Simms et al. | 367/134 |
| 4,657,039 | 4/1987 | Bireley et al. | 137/78.3 |
| 4,918,433 | 4/1990 | Moore | 340/573.6 |
| 5,091,714 | 2/1992 | de Solminihac | 340/573.6 |
| 5,115,222 | 5/1992 | Peralta et al. | 340/573.6 |
| 5,138,300 | 8/1992 | Chance | 340/573.6 |
| 5,144,285 | 9/1992 | Gore | 340/573.6 |
| 5,274,359 | 12/1993 | Adams | 340/604 |
| 5,408,222 | 4/1995 | Yaffe et al. | 340/604 |
| 5,486,814 | 1/1996 | Quinones | 340/573.6 |
| 5,551,288 | 9/1996 | Geraldi et al. | 73/170.26 |
| 5,619,187 | 4/1997 | Serfontein | 340/573.6 |
| 5,710,989 | 1/1998 | Flood | 455/100 |
| 5,748,080 | 5/1998 | Clay | 340/539 |
| 5,874,672 | 2/1999 | Gerardi et al. | 73/170.26 |
| 5,886,635 | 3/1999 | Landa et al. | 340/573.6 |
| 5,900,817 | 5/1999 | Olmassakian | 340/573.1 |
| 5,945,912 | 8/1999 | Guldbrand | 340/573.1 |

*Primary Examiner*—Benjamin C. Lee
*Attorney, Agent, or Firm*—Freedman & Associates

[57] ABSTRACT

The present invention relates to a portable water safety monitoring device including a transmitter to be worn on a person, and a base station for monitoring any transmission from the transmitter indicating immersion of the transmitter in water. The device is particularly applicable for monitoring children near a swimming pool or other body of water to prevent drowning accidents. The transmitter is a compact printed circuit board carrying a capacitance water sensor and a sealed circuitry for detecting a change in capacitance and transmitting an alarm signal to the base station. Advantageously, on opposing sides of the printed circuit board large perimeter conductors provide a sensor able to register a varying level of capacitance. This can reduce false alarms due to incidental wetting. As a further advantage, the use of a compact printed circuit board eliminates any exposed leads in the construction, which could be damaged or disconnected by a child deactivating the monitor. A masked encapsulating sealant protects the circuitry from exposure to water while the sensor remains exposed. The design achieves additional compact efficiency by using one of the perimeter conductors as an antenna for transmitting the signal.

27 Claims, 9 Drawing Sheets

WATER SAFETY PORTABLE TRANSMITTER AND RECEIVER

This application claims benefit of provisional application No. 60/094,144 filed Jul. 24, 1998.

FIELD OF THE INVENTION

This invention relates to a portable transmitter and remote monitoring receiver for detecting the presence of water around the transmitter, particularly a monitor having a settable wetness threshold for triggering the alarm.

BACKGROUND OF THE INVENTION

Monitoring for water safety can be greatly improved to prevent accidents, particularly involving children, by accurate and immediate notification of a water accident. This is critical since a drowning death can occur in just a few minutes. Reliability to accurately detect water immersion is essential. If a child has fallen into water, any time delay threatens the child's life. A false alarm from a monitoring system is acceptable, if there is assurance that a positive water emergency will not go undetected. However, false alarms cannot be so frequent that the alarm fails to initiate an urgent response. The sensitivity of the monitoring system should be settable such that incidental wetting from sprinklers, taps, splash, rain or perspiration does not trigger the alarm.

In addition, to be effective as a monitor for children, the transmitter must be securely fastened to the child and resistant to tampering. A casing which opens to facilitate battery replacement can be opened by a child and disabled without intent, and without the knowledge of the supervising adult. Waterproof circuitry for electrical water safety devices generally comprises hermetically coated wires and water sealed containers. The use of a single printed circuit board is attractive since no leads can be inadvertently disconnected by a child.

U.S. Pat. No. 5,408,222 issued Apr. 18, 1995 by Yacob Yaffe et al. discloses a timing means that allows an alarm to sound after immersion in fluid for a determined interval. This may be useful for monitoring weak swimmers, but immersion of a non-swimmer must be responded to immediately. A timing delay of emergency response increases the risk of the child drowning or suffering other immersion injury such as brain damage. The device includes a sensor, a timing circuit and a transmitter that is activated in response to a 40–60 second immersion time. An antenna comprises a wire lead incorporated in a securing headband. The structure of the circuitry is not as compact and tamper resistant as a printed circuit. The device is also not sensitive to distinguish incidental wetness from immersion.

A further patent U.S. Pat. No. 4,918,433 issued Apr. 17, 1990 to Robert Moore discloses a belt mounted transmission monitor. In a horizontal position the sensors are shielded from falling water such as rain, etc. The sensors do not have a settable threshold to indicate a level of wetness. Like the headband device, the belt circuitry is rather large carrying a separate transmitter unit and is not as resistant to tampering with leads as a printed circuit board.

A more complex system is disclosed in U.S. Pat. No. 5,650,770 issued Jul. 22, 1997 to Dan Schlager et al. comprising a monitoring system for location surveillance by GPS or distance detection as well as a variety of hazard sensors including an immersion sensor. The system includes a panic button for the user to alert the base station. For child safety, an alarm needs to be automatic. Because the device transmits a status regularly, the greater power demand requires a larger battery and a larger device. The complexity, cost and size are beyond the needs of most users for backyard safety. A simple, reliable, compact and economical device is needed.

It is an object of the invention to provide a monitoring system for detecting a child's immersion in water which is reliably automatic, resistant to false alarm and resistant to tampering or damage which would disable the system.

It is a further object to provide a low energy system that provides reliable response over a long use period.

SUMMARY OF THE INVENTION

The present invention has found that a very compact and reliable device can be created on a single printed circuit board, which provides a capacitor designed to offer a settable threshold capacitance before initiating an alarm signal. A hermetic seal masked over a portion of the printed circuit board, leaving the sensing capacitor exposed for water detection, creates a compact, water and impact resistant device without leads that could become disconnected. One of the peripheral traces forming the capacitor can also efficiently be used as an antenna. Thus a compact, sealed and tamperproof design is provided which offers a reliable response to water immersion.

In accordance with the invention there is provided a portable water safety monitoring device for use with a receiving station comprising:

- a water sensor comprising a first electrode and a second electrode forming a capacitor, wherein the first and second electrodes are dimensioned to provide a variable capacitance in response to an area of the electrodes exposed to water;
- a circuit portion electrically coupled to the water sensor including:
- a power source
- a control circuit for detecting the capacitance of the water sensor for determining a presence of water;
- a transmitter for generating a signal in response to detection by the control circuit of the presence of water for transmission to the receiving station for generating an alarm; and,
- a transmitting antenna for transmitting a signal from the transmitter to the receiving station.

In accordance with a further preferred embodiment of the invention, there is provided a portable water safety monitoring device comprising: a first circuit board area having a first electrode and a second electrode forming a capacitor; a second circuit board area including a second circuit portion having a power source and means for detecting a presence of water on the first circuit board area in dependence upon variations in capacitance between the first and second electrodes, a watertight seal to prevent water contact to the second circuit portion, and a transmitting antenna for transmitting a signal in dependence upon a signal provided within or from the second circuit portion.

In accordance with a still further preferred embodiment of the present invention there is provided a portable water safety monitoring device comprising: a first circuit board area including a first circuit portion having a power source, a seal comprising a waterproof material applied directly to the first circuit area to seal the first circuit area to prevent water contact to the first circuit portion, a second circuit board area having a second circuit portion including a first trace extending about the circuit board on a first side thereof and a second trace extending about the circuit board on an opposing side thereof, wherein the first and second trace form a capacitor and wherein the first trace also forms a transmitting antenna, wherein the first circuit portion comprises means for detecting a presence of water on the second circuit board area in dependence upon changes in capacitance between the first and second traces.

Advantageously, the device includes a settable threshold to detect immersion and to eliminate false alarms from incidental wetting.

BRIEF DESCRIPTION OF THE DRAWINGS

Exemplary embodiments of the invention will now be described in accordance with the drawings in which.

DETAILED DESCRIPTION OF THE INVENTION

Figure 1:
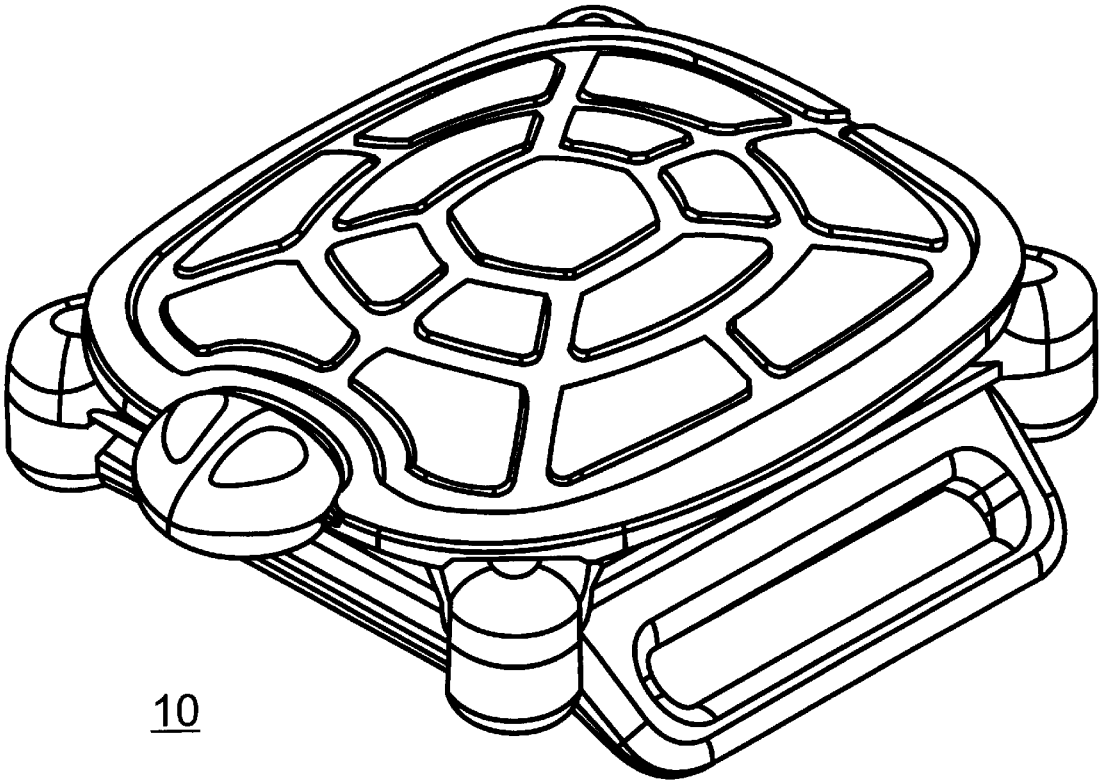
FIG. 1 is an isometric view of the remote device transmitter, shown without its securing strap.
Figure 5:
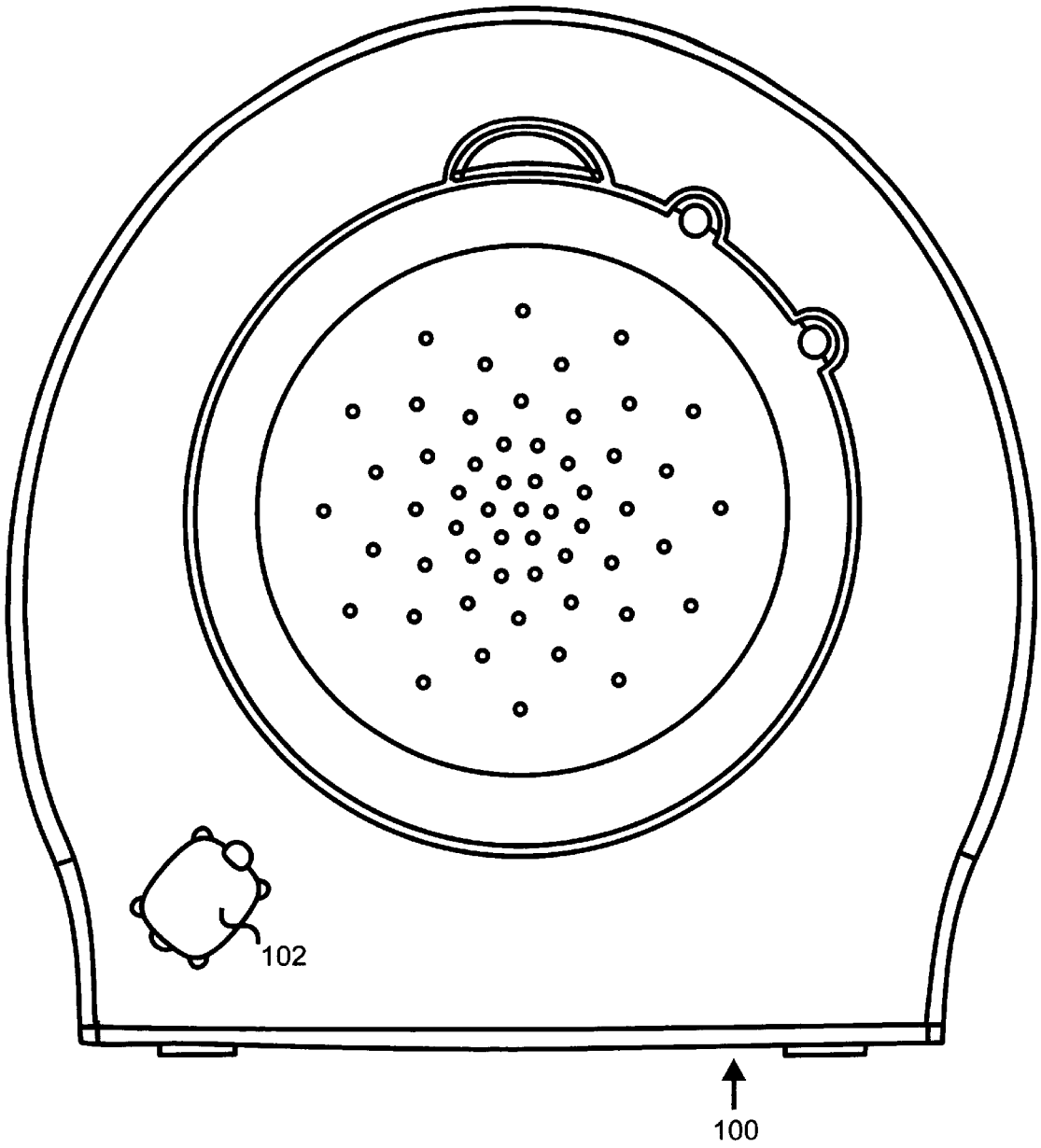
FIG. 5 is a front view of a receiving base station for cooperation with the remote device transmitter.
Figure 6:
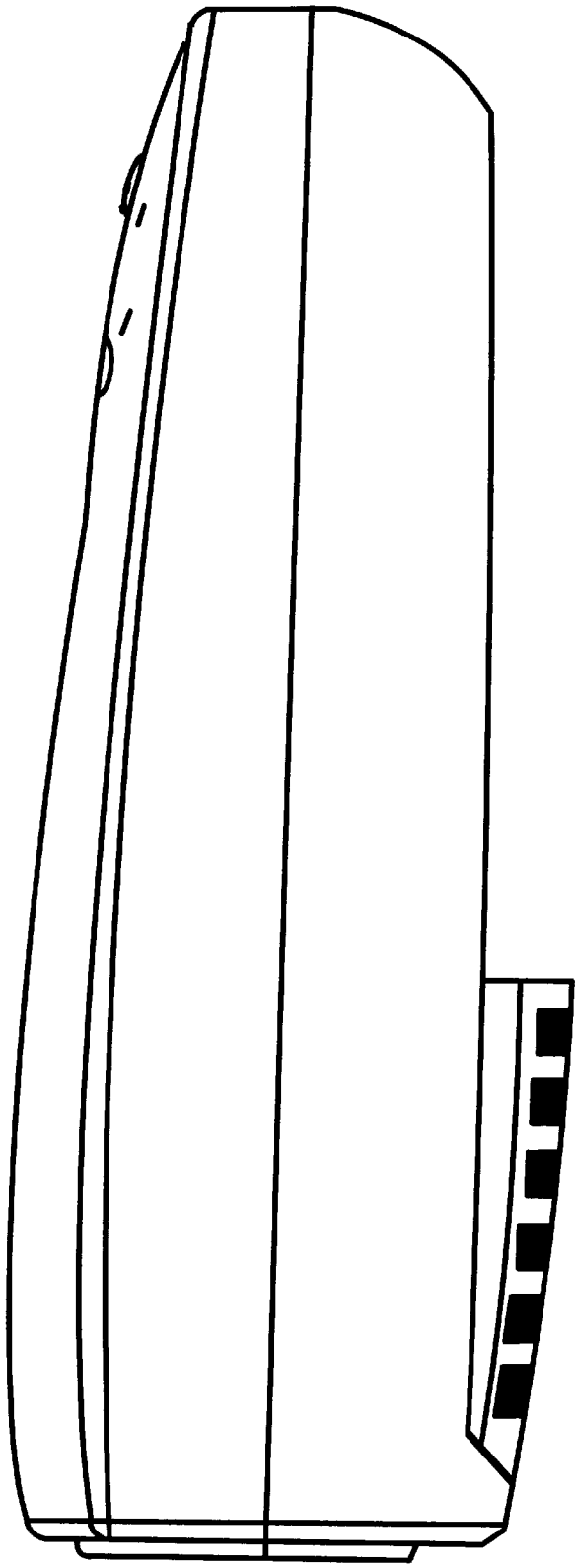
FIG. 6 is a side view of the receiving base station of FIG. 5.

The monitoring system in accordance with the present invention includes one or more remote devices, shown generally at 10 in FIG. 1, programmed for radio contact with a base station 100, shown in FIG. 5, within a defined area, in the event of water immersion of the remote device 10. The base station provides an alarm to a supervising adult. The remote device is a transmitter adapted to be worn on the body or clothing of the user, for example about the wrist, or as a belt, necklace or pin. Not shown, is the strap adapted to secure the remote device 10 about the wrist of the user. It is understood that the present invention can be used in a number of different circumstances, such as marine or shoreline safety. A primary use is, however, to prevent a child's accidental drowning. The user will frequently be referred to as the child, though this is not intended to limit the invention.

The remote device 10 monitors capacitance and transmits a signal over a radio link if exposure to water changes the capacitance beyond a threshold limit. The base station 100 receives the signal, and generates an audible alarm. The base station 100 is preprogrammed to receive signals from a number of remote devices 10, but does not recognize other signals, as for instance from neighboring systems. This helps to reduce interference which might cause troubling false alarms.

Figure 4B:
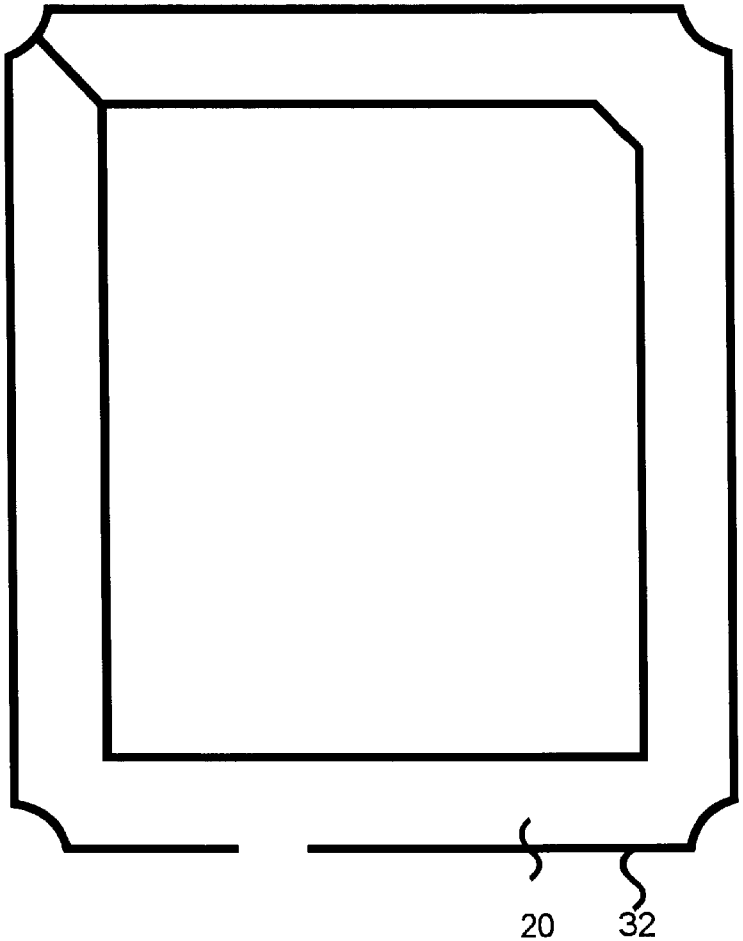
FIG. 4B is a schematic illustration of the opposite side of the printed circuit board showing the peripheral conductor trace on the opposing side.
Figure 4A:
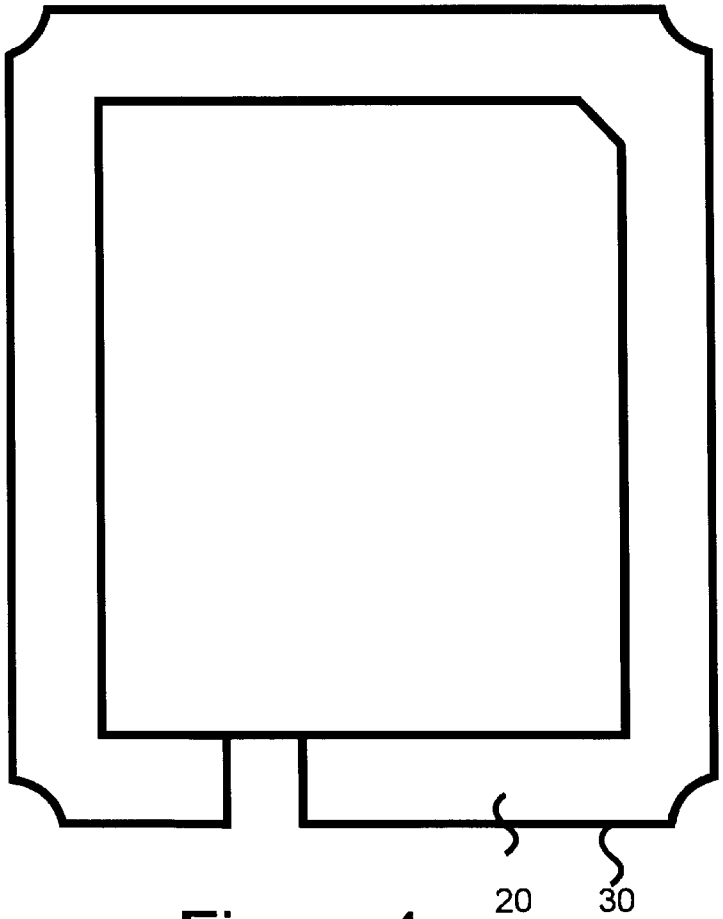
FIG. 4A is a schematic illustration of one side of the printed circuit board showing the peripheral conductor trace.

The remote device 10 comprises a wrist worn device in a preferred embodiment. The remote device 10 comprises a two-part attractive and durable housing 12 for encasing a printed circuit board 20. The compact printed circuit board 20 includes a water sensor 22 comprising a parallel conductor capacitor; a transmitter 24, for generating the radio signal; a programmable microcontroller 26, comprising a control circuit for coordinating operation of the sensor and transmitter; an antenna 30, seen clearly in FIG. 4A, for radiating the radio signal; and a battery power source 28. The capacitor is preferably a pair of traces 30, 32, seen in FIGS. 4A and 4B, about the periphery on opposite sides of the circuit board 20. The use of large conductor area permits a settable threshold response to changes in capacitance. This reduces false alarms resulting from splash water as opposed to immersion. Advantageously, one of the traces 30 is a loop which functions as the antenna. The current consumption of the control circuitry is extremely low, giving an operational life of several years in normal use. The microcontroller 26 is powered only while the remote device 10 is immersed in water.

Figure 2A:
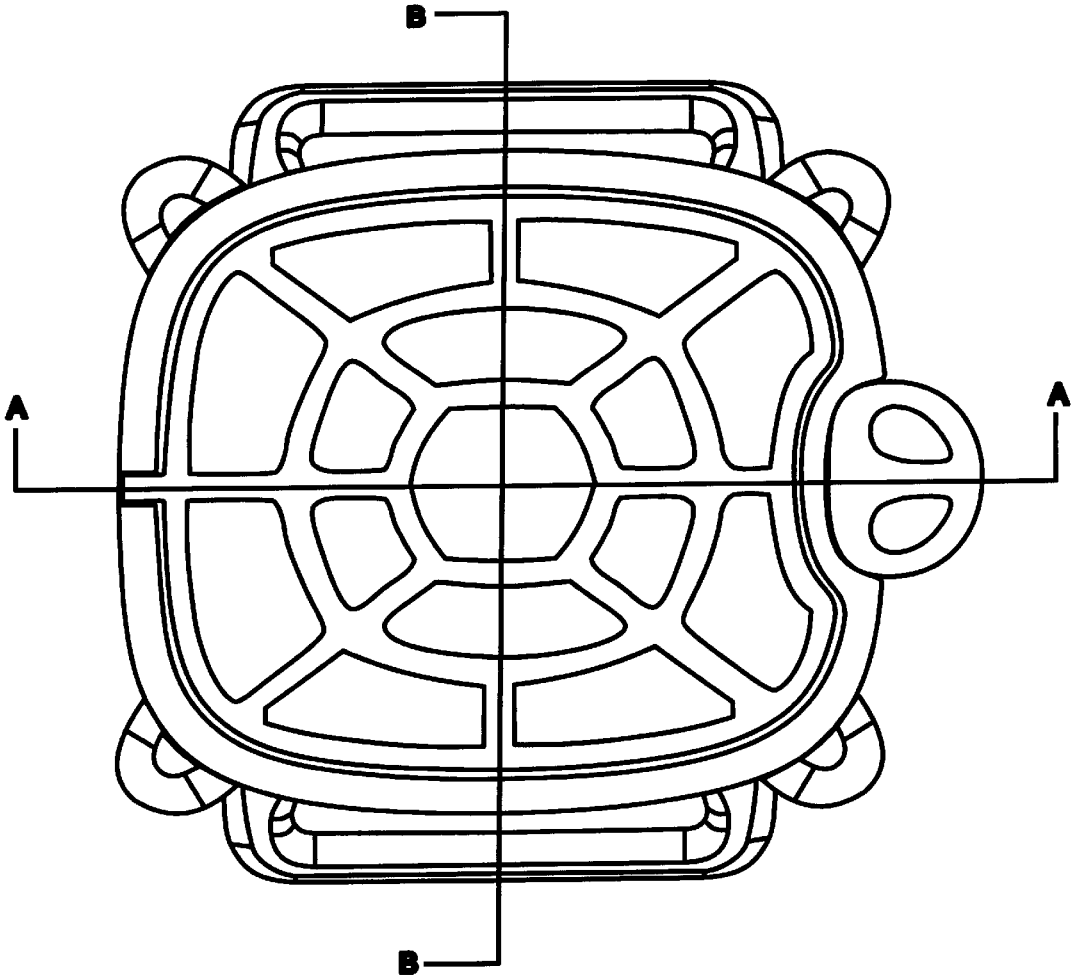
FIG. 2A is a plan view of the embodiment of FIG. 1.
Figure 2B:
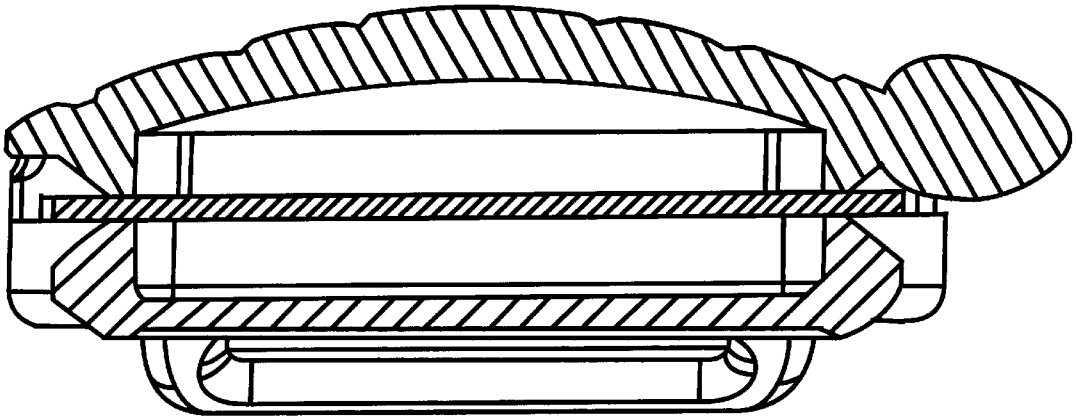
FIG. 2B is a sectional view through line A—A of FIG. 2A.
Figure 2C:
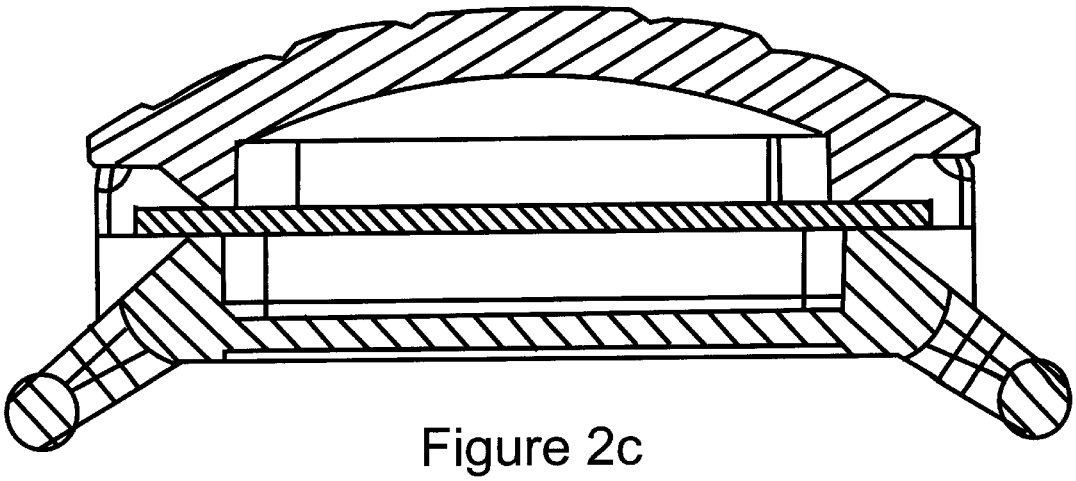
FIG. 2C is a sectional view through line B—B of FIG. 2A.
Figure 3:
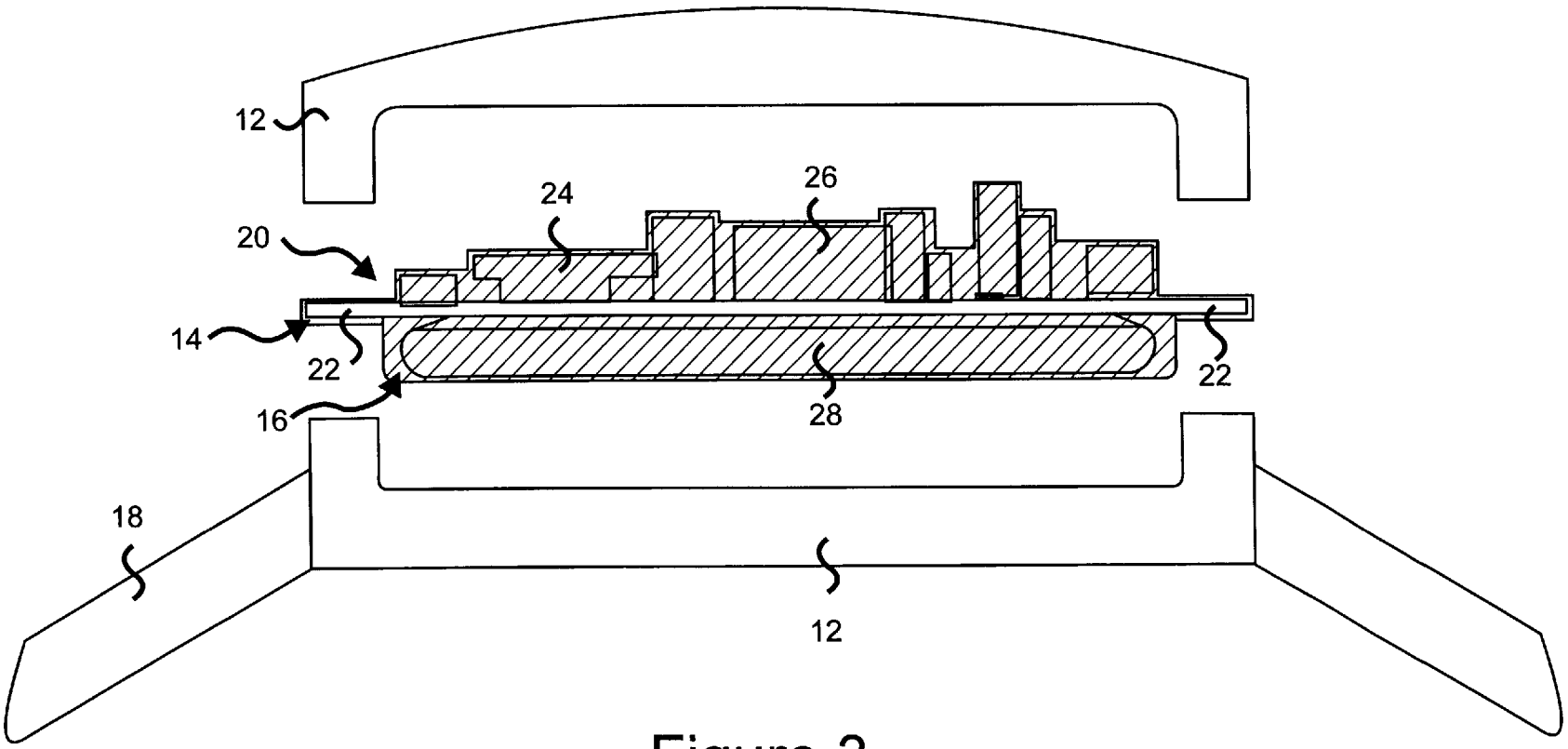
FIG. 3 is a schematic sectional illustration of the invention.

The printed circuit board 20 is first coated with a conformal coating 14. A masked portion of the board 20 is then encapsulated within a polyurethane oligomer mixture encapsulant 16 to protect against water and moisture. Encapsulation provides additional shock resistance. The sensor portion 22 comprising the parallel conductors 30, 32 remains exposed. The housing protects the electronic elements from tampering or shocks, but the sensor portion 22 is not encapsulated and extends beyond a closed area of the housing 12. The sensor portion 22 of the printed circuit board 20 is shielded from exposure to incidental moisture such as splash water, sprinklers, rain or perspiration by an umbrella type design at the edges of the housing 12, seen clearly in FIGS. 2B and 2C.

Of course numerous alternative design elements can be selected to limit the sensor exposure to immersion in water, such as a Pasteur tube, fine mesh or other structures readily apparent to persons of skill in the art.

The device is attached by a wrist strap 18 adjustable to the size of the user. The strap 18 includes a buckle designed such that it is difficult to remove the remote device 10 with one hand. A tool operated buckle can be used. It is important to reduce the risk of the device being removed by the child which would create a false sense of monitoring security.

The transmitter 24 preferably consists of a single-transistor oscillator, using a surface-acoustic-wave resonator for frequency control. The oscillator is keyed by the control circuitry by switching the transistor bias current. The frequency is approximately 318.0 MHz ±200 kHz derived from a SAW resonator. The frequency is selected to provide acceptable loss in transmission from a depth of water such as a swimming pool while permitting the use of a small antenna.

The control circuitry consists of a programmable microcontroller 26 and a few standard logic gates. In addition, the water sensor 22 employs several discrete transistors, and an integrated voltage sensor is used to detect the battery-low condition. A clock for the microcontroller 26 is derived from a ceramic resonator, which ensures that the transmitted bit rate is close to its nominal value. The microcontroller 26 is a one-time programmable microchip. Preferably it requires no external components except a clock resonator. A suitable chip executes at 1 MIPS and provides 25 bytes of RAM and 512 words of instruction ROM.

A low-battery detection operation is necessary for reliability. This is provided by a voltage sensor which signals the battery-low condition when the voltage falls below a threshold level. The voltage sensor is connected in parallel to the microcontroller 26 rather than directly across the battery 28 so that no current is drawn in the inactive state.

The settable immersion threshold is preprogrammed and can represent, for instance, a selected portion of the circumference of the trace, such as one third of the circumference immersed.

In a preferred embodiment, the battery 28 is encapsulated with the printed circuit board 20. Although this makes the battery 28 non-replaceable, it prevents the accidental disabling which could occur if a child were to remove or disconnect the battery 28. The encapsulation process involves placing the assembled printed circuit board 20, with all components mounted to it and the battery 28 connected, into a potting fixture. The conductor traces 30, 32 are masked by protective silicone gaskets. The board 20 is enclosed within the potting fixture with the silicone gaskets tightly sealing the sensor portion 22. The potting fixture frames a volume to be filled with encapsulant 16. The encapsulant 16 is preferably a UV cured polyurethane oligomer mixture which is cured and then the opposite side is encapsulated surrounding the battery 28 and cured. Alternatively, an X-Y dispensing device can be used to accurately place encapsulant without the potting fixture.

The base station 100 receiver is a low-voltage AC device. The receiver consists of a SAW filter and an integrated receiver device. The receiver is driven by a local oscillator based on a SAW resonator very similar to that used in the remote device transmitter, but offset in frequency. The control circuitry consists of a programmable microcontroller. The clock for the microcontroller is derived from a ceramic resonator as in the remote device. The microcontroller processes the received signal to recognize transmissions from remote devices 10, and activates an audible alarm when a transmission is detected. Only transmissions carrying the code matching that of the receiver are recognized. Preferably a plug 102 associated with the remote devices 10 is used to provide code selection to determine the transmission code to which the base station will respond. A simple color coding scheme to match the code selection plug 102 and the remote devices 10 is used. The use of a repeated code word as the transmitted data pattern allows the base station 100 to distinguish associated remote devices from other transmitters, such as other similar transmitters from a neighboring system, or other devices such as baby monitors, garage openers etc.

The receiver provides a complete AM receiver chain, including mixer, IF amplifier, and logarithmic detector, with a minimum of external components. The receive chain consists of a SAW filter and an integrated receive device, feeding baseband signal conditioning circuitry. The receiver is driven by a local oscillator based on a SAW resonator.

The SAW filter provides good rejection outside the passband. The frequency accuracy and passband width should match those of the remote device. As in the remote device, the microcontroller is a one-time programmable microchip requiring no external components except a clock resonator. It executes at 5 MIPS and provides 192 bytes of RAM, 4 k words of instruction ROM and an 8-bit A/D converter. A peizo-electric bender is used for generating high volume level alarm in the frequency range of 2.0–2.5 kHz.

The SAW Resonator is similar to that in the remote device 10. It has a local oscillator frequency of 315 MHz, giving an IF of 3 MHz, which provides good IF performance and stability. The IF processing must have sufficient bandwidth to accommodate the frequency uncertainty of the remote device transmitter.

Figure 7A:
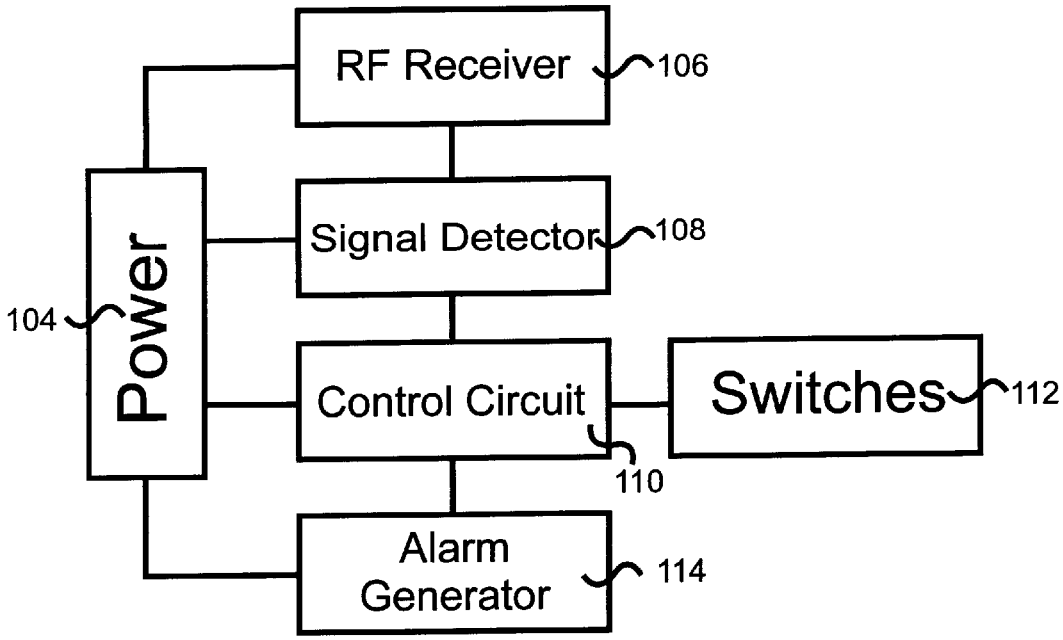
FIG. 7A is a block diagram of the receiving base station.

Block diagrams shown in FIGS. 7A–7D illustrate the basic configuration of the receiving base station 100 and alternative configurations of the remote device 10. FIG. 7A generally illustrates the receiving base station 100 comprising a power source 104 providing power to the RF receiver 106, coupled to the signal detector 108, controlled by the control circuit 110 including switches 112 to activate the alarm 114.

Figure 7B:
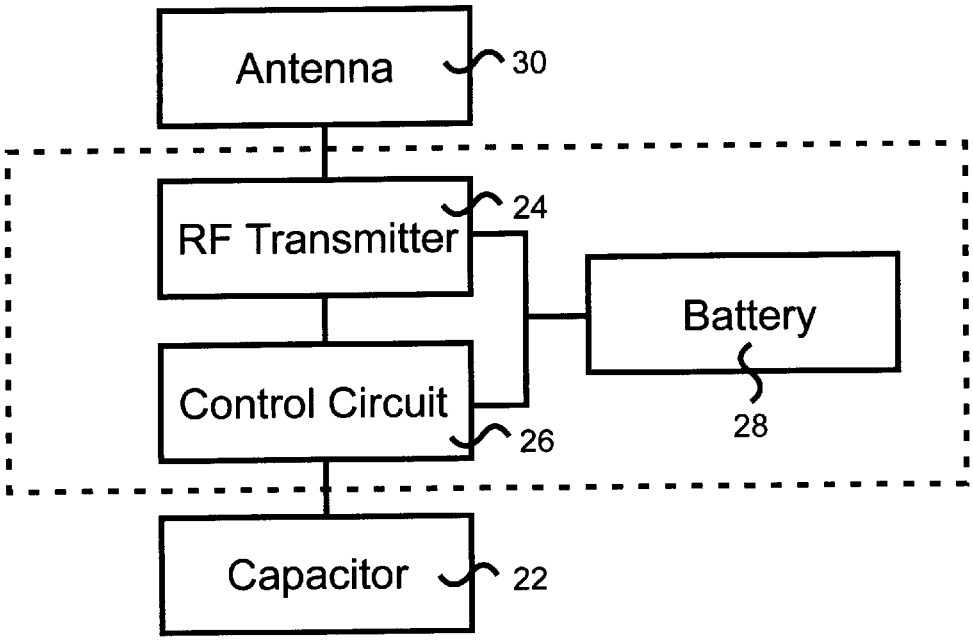
FIG. 7B is a block diagram of the basic remote device transmitter.
Figure 7C:
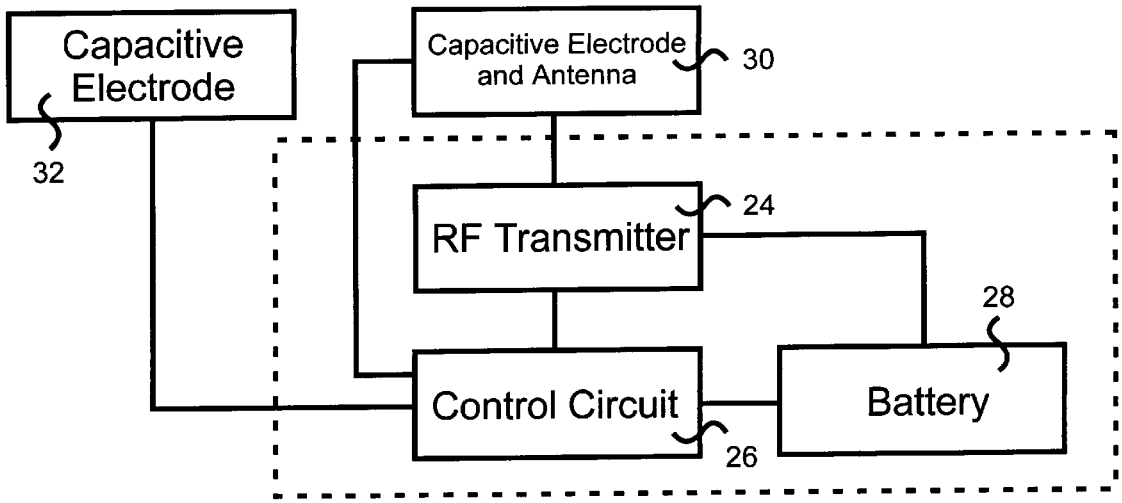
FIG. 7C is a block diagram of a preferred remote device transmitter utilizing a first electrode as the transmitting antenna; and, FIG. 7D is a block diagram of an alternative embodiment to FIG. 7A in which the antenna is protected by the water tight seal.
Figure 7D:
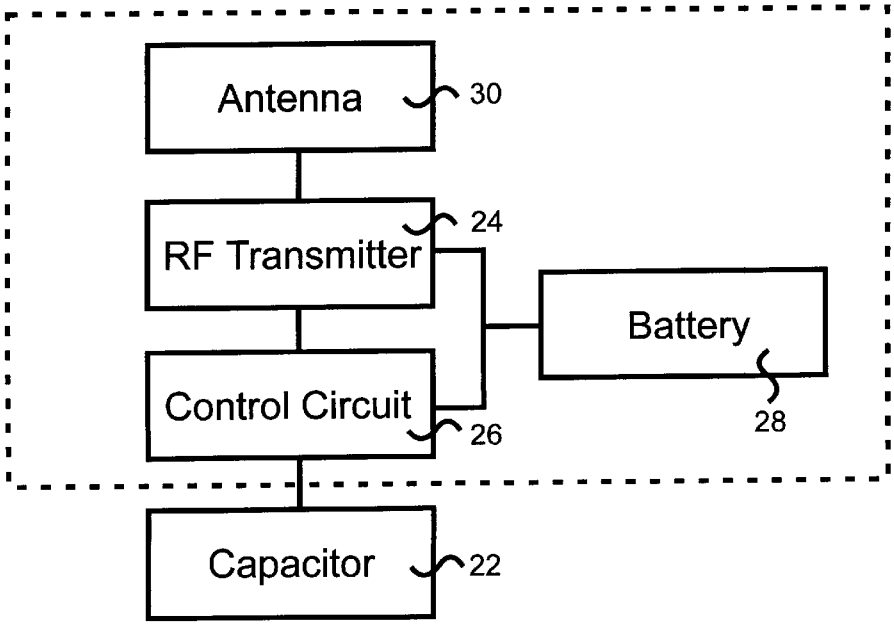

FIG. 7B shows a basic remote transmitter device 10 comprising a battery 28, control circuit 26 and an RF transmitter 24 encapsulated within a water tight seal, shown in dashed lines, and an antenna 30 and capacitor sensor 22 outside the water tight seal. FIG. 7C illustrates an alternative embodiment to that shown in FIG. 7B, in which the two capacitive electrodes 30, 32 are shown outside the water tight seal, and one of the capacitive electrodes 30 further comprises the antenna 30. FIG. 7D illustrates a further alternative embodiment of the remote transmitter device 10 to that shown in FIG. 7B. In this case the antenna 30 is included with the control circuit 26, transmitter 24 and battery 28 within the water tight seal.

In use a remote transmitter is affixed to each user, as by a wrist band. Partial wetting of a remote device 10 below a preset threshold will not cause the transmitter to register water detection. If a remote device 10 is immersed, the sensor 22 will detect a sufficient change in capacitance. This causes the microcontroller 26 to draw power to initiate a signal transmission by the transmitter 24. The signal is received by the base station 100, recognized and an alarm is sounded until the remote device is removed from the water and the base station 100 is reset. The signal is a code word. The code word permits identifying a monitored remote device 10. After 10 seconds of continuous transmission, the code word is transmitted as a pulsed signal. The remote device continues to transmit a pulsed signal for a duration, eg. 15 minutes, or until it is removed from the water. The pulsation reduces interference if more than one remote device 10 is transmitting.

The above-described embodiments of the invention are intended to be examples of the present invention and numerous modifications, variations, and adaptations may be made to the particular embodiments of the invention without departing from the scope and spirit of the invention, which is defined in the claims.

What is claimed is:

1. A portable water safety monitoring device for use with a receiving station comprising:

a water sensor comprising a first electrode and a second electrode forming a capacitor, wherein the first and second electrodes are dimensioned to provide a variable capacitance in response to an area of the electrodes exposed to water;

a circuit portion electrically coupled to the water sensor including:

a power source a control circuit for detecting the capacitance of the water sensor for determining a presence of water;

a transmitter for generating a signal in response to detection by the control circuit of the presence of water for transmission to the receiving station for generating an alarm; and, a transmitting antenna for transmitting a signal from the transmitter to the receiving station.

2. A portable water safety monitoring device as defined in claim 1, wherein the control circuit has a settable threshold means for determining the presence of water.

3. A portable water safety monitoring device as defined in claim 2, wherein the settable threshold means comprises a variable resistance forming part of an RC circuit with the capacitance of the water sensor for varying the charge time of the capacitor.

4. A portable water safety monitoring device as defined in claim 1, wherein the control circuit comprises a reference capacitor; and a comparator for comparing the capacitance of the water sensor and of the reference capacitor.

5. A portable water safety monitoring device as defined in claim 4, wherein the comparator comprises means for charging the water sensor; means for charging the reference capacitor; and means for detecting which capacitor charges to a threshold voltage first, wherein both the water sensor and the reference capacitor are charged through an approximately same resistance.

6. A portable water safety monitoring device as defined in claim 4, wherein the first and second electrodes are disposed on opposing sides of a circuit board and coated to prevent corrosion when the board is in contact with water, the coating resulting in a known reference capacitance between the electrodes in air.

7. A portable water safety monitoring device as defined in claim 6, wherein the first electrode and the second electrode comprise traces extending about a periphery on opposite sides of the circuit board.

8. A portable water safety monitoring device as defined in claim 7, wherein the circuit portion is provided the circuit board and is protected from contact with water by a watertight seal, and wherein the traces are provided on the same circuit board and are not protected by the watertight seal.

9. A portable water safety monitoring device as defined in claim 8, wherein the watertight seal comprises:

a resin applied to a surface of the circuit board for coating a portion of the circuit board less than the whole.

10. A portable water safety monitoring device as defined in claim 8, wherein the watertight seal comprises an encapsulation of the circuit portion of the circuit board including the battery and components forming part of the circuit and disposed on the circuit board.

11. A portable water safety monitoring device as defined in claim 10, wherein the first electrode and the transmitting antenna are a same physical circuit component on the circuit board.

12. A portable water safety monitoring device as defined in claim 11, wherein the signal generated by the transmitter is a programmed code word, and wherein the receiving station is preprogrammed to recognize the code word of the portable monitoring device in order to generate an alarm.

13. A portable water safety monitoring device as defined in claim 12, wherein the signal generated by the transmitter is of a first polarity of the programmed codeword when the remaining battery charge is above a predetermined threshold and of a second other polarity of the programmed codeword when the remaining battery charge is below the predetermined threshold, wherein the receiving station is preprogrammed to recognise both polarities and distinguish between them.

14. A portable water safety monitoring device as defined in claim 12, further including a housing for encasing the circuit portion which provides protection for the water sensor from incidental wetting and allows the water sensor to provide a capacitance beyond a preset threshold when a sufficient area of the capacitor is exposed to water.

15. A portable water safety monitoring device as defined in claim 14, wherein the device is adapted to be worn about a user's wrist.

16. A portable water safety monitoring device as defined in claim 4, wherein the first and second electrodes are disposed on a same side of a circuit board and coated to prevent corrosion when the board is in contact with water, the coating resulting in a known reference capacitance between the electrodes in air.

17. A portable water safety monitoring device as defined in claim 16, wherein the first and second electrodes are disposed concentrically.

18. A portable water safety monitoring device as defined in claim 1, wherein the signal generated by the transmitter includes information relating to a status of the battery powering the transmitter, the indication for use in determining when a transmitter is no longer reliable.

19. A portable water safety monitoring device as defined in claim 18, wherein the signal generated is of a first polarity when the remaining battery charge is above a predetermined threshold and of a second other polarity when the remaining battery charge is below the predetermined threshold.

20. A portable water safety monitoring device comprising:

a first circuit board area having a first electrode and a second electrode forming a capacitor;

a second circuit board area including a second circuit portion having a power source and means for detecting a presence of water on the first circuit board area in dependence upon variations in capacitance between the first and second electrodes, a watertight seal to prevent water contact to the second circuit portion, and a transmitting antenna for transmitting a signal in dependence upon a signal provided within or from the second circuit portion.

21. A portable water safety monitoring device as defined in claim 20 wherein the seal comprises a resin applied directly to the second circuit board area sealing the second circuit board area while leaving the first circuit board area exposed.

22. A portable water safety monitoring device as defined in claim 20 wherein the first and second electrodes are disposed on opposing sides of the circuit board and extend about the circuit board.

23. A portable water safety monitoring device as defined in claim 22 wherein the first electrode and the transmitting antenna are a same physical circuit component on the circuit board.

24. A portable water safety monitoring device as defined in claim 23 wherein the first electrode and the second electrode comprise traces on opposing sides of the circuit board extending about a periphery of the circuit board.

25. A portable water safety monitoring device as defined in claim 24 comprising a housing for substantially preventing splashed water from contacting the first and second electrodes while allowing water to contact the first and second electrodes when the device is immersed therein.

26. A portable water safety monitoring device as defined in claim 20 comprising a housing for substantially preventing splashed water from contacting the first area of the circuit board while allowing water to contact the first area of the circuit board when the device is immersed.

27. A portable water safety monitoring device comprising:

a first circuit board area including a first circuit portion having a power source, a seal comprising a waterproof material applied directly to the first circuit area to seal the first circuit area to prevent water contact to the first circuit portion, a second circuit board area having a second circuit portion including a first trace extending about the circuit board on a first side thereof and a second trace extending about the circuit board on an opposing side thereof, wherein the first and second trace form a capacitor and wherein the first trace also forms a transmitting antenna, wherein the first circuit portion comprises means for detecting a presence of water on the second circuit board area in dependence upon changes in capacitance between the first and second traces.

* * * * *